US006875102B2

(12) United States Patent
Achen

(10) Patent No.: US 6,875,102 B2
(45) Date of Patent: Apr. 5, 2005

(54) MOISTURE RESISTANT WALL VENT

(76) Inventor: John J. Achen, 12432 Del Rico, Yuma, AZ (US) 85367

( * ) Notice: Subject to any disclaimer, the term of this patent is extended or adjusted under 35 U.S.C. 154(b) by 95 days.

(21) Appl. No.: 10/393,090

(22) Filed: Mar. 20, 2003

(65) Prior Publication Data

US 2004/0058638 A1 Mar. 25, 2004

Related U.S. Application Data

(63) Continuation-in-part of application No. 10/242,890, filed on Sep. 13, 2002, now Pat. No. 6,746,324.

(51) Int. Cl.[7] ..... F24F 7/10
(52) U.S. Cl. ..... 454/283; 454/276; 454/277
(58) Field of Search ..... 454/48, 271, 273, 454/275, 276, 277, 254, 283; 55/385.2, 501, 506

(56) References Cited

U.S. PATENT DOCUMENTS

| | | | | | |
|---|---|---|---|---|---|
| 637,519 | A | | 11/1899 | Mertins | |
| 2,790,376 | A | | 4/1957 | Kennedy et al. | 98/114 |
| 2,930,309 | A | | 3/1960 | Prager | 98/118 |
| 3,687,052 | A | * | 8/1972 | Schonberg | 454/195 |
| 3,740,934 | A | | 6/1973 | Shuler | 55/490 |
| 3,964,376 | A | | 6/1976 | Janke | 98/59 |
| 4,469,018 | A | | 9/1984 | Taulman | 98/37 |
| 4,550,648 | A | | 11/1985 | Eagle | 98/37 |
| 4,592,271 | A | | 6/1986 | Young | 98/114 |
| 4,676,145 | A | | 6/1987 | Allred | 98/29 |
| 4,699,045 | A | | 10/1987 | Hensley | 98/37 |
| 4,754,696 | A | | 7/1988 | Sarazen et al. | 98/29 |
| 4,770,087 | A | | 9/1988 | Danley et al. | 98/87 |
| 4,821,628 | A | * | 4/1989 | Sarazen et al. | 454/276 |
| 4,911,066 | A | | 3/1990 | Carew | 98/121.1 |
| 5,120,273 | A | | 6/1992 | Lin | 454/195 |
| 5,194,038 | A | | 3/1993 | Klomhaus et al. | 454/162 |
| 5,293,920 | A | * | 3/1994 | Vagedes | 160/89 |
| 5,349,799 | A | | 9/1994 | Schiedegger et al. | 52/473 |
| 5,394,663 | A | | 3/1995 | Jackson | 52/199 |
| 5,482,507 | A | * | 1/1996 | Priest | 454/359 |
| 5,487,701 | A | | 1/1996 | Schedegger et al. | 454/271 |

(Continued)

OTHER PUBLICATIONS

Brochure entitled "Clopay 4200/4201—Steel Insulated Raised Panel & Flush Garage Doors", by Clopay Corporation, 1993 (4 pages).

Catalog entitled "POLAR Hardware Mfg. Co., Inc.", Catalog No. 90, Chicago, Illinois (cover page, p. 69 and last page), undated.

*Primary Examiner*—Gregory Wilson
(74) *Attorney, Agent, or Firm*—Cahill, Von Hellens & Glazer P.L.C.

(57) ABSTRACT

A moisture resistant wall vent for use in an exterior wall of a building includes a louvered front panel substantially in the plane of the wall surface whether the wall has a stucco finish, conventional wall finish or a brick surface. Alternatively, the louvered panel may be recessed from the front edge of the vent coincident with the finish of the exterior wall. Top, bottom, left and right side panels of the vent include laterally extending right angle flanges disposed proximate the rear edges to resist seepage of water along the vent into the wall. To mount the vent in a concrete block wall, a laterally extending T-shaped lintel is attached through slots (for the concrete block wall) disposed in the top panel and a laterally extending plate (if used) is attached through slots disposed in the bottom panel. The slots permit outward and inward repositioning of the vent to accommodate the finish on the concrete block wall and to maintain the front panel essentially in the plane of the exterior surface of the wall. To mount the vent in a brick wall, the right angle flanges are attached to underlying framing and an L-shaped lintel supports the course of bricks overlying the vent. To mount the vent in an insulating concrete form exterior wall, the right angle flanges are attached to a buck lodged in the wall.

54 Claims, 12 Drawing Sheets

U.S. PATENT DOCUMENTS

| | | | | | |
|---|---|---|---|---|---|
| 5,590,477 | A | | 1/1997 | Carfagno, Sr. | 34/235 |
| 5,758,457 | A | | 6/1998 | Achen | 52/198 |
| 5,950,384 | A | * | 9/1999 | Aarness | 52/473 |
| 5,976,007 | A | | 11/1999 | Powell et al. | 454/48 |
| 5,976,009 | A | | 11/1999 | Achen | 454/195 |
| 6,012,260 | A | | 1/2000 | Hendrick et al. | 52/302.1 |
| 6,113,488 | A | | 9/2000 | Tiede | 454/276 |
| 6,431,980 | B1 | * | 8/2002 | Achen | 454/271 |
| 6,604,994 | B2 | * | 8/2003 | Achen | 454/271 |

* cited by examiner

MOISTURE RESISTANT WALL VENT

CROSS REFERENCE TO RELATED APPLICATION

The present application is a continuation-in-part application of an application entitled "Combustion Air Wall Vent", filed Sep. 13, 2002 now U.S. Pat. No. 6,746,324, and assigned Ser. No. 10/242,890 describing an invention made by the present inventor.

BACKGROUND OF THE INVENTION

1. Field of the Invention

The present invention relates to wall vents and, more particularly, moisture resistant wall vents adapted for use within exterior walls whether of brick, or of concrete block or framing having a stucco type finish.

2. Description of Related Art

During the summertime in the southwest United States and in climatologically similar areas, the temperature in an unvented enclosed garage increases to well over 100° F. Such a high temperature may cause damage or deterioration to temperature sensitive items stored or otherwise disposed within such a garage. Moreover, the high temperatures render it very uncomfortable for a person working within the garage. To alleviate this problem, it is not uncommon to install vents in one or more exterior walls of a garage to permit airflow into and out of the garage.

The simplest of such vents are a louvered panel of relatively light weight material nailed or screwed to the exterior surface of a wall in juxtaposed relationship with a corresponding aperture. Such light weight louvered panels are easily removed by a person intending to commit mischief within the garage. Other more robust vents have been used in conventional walls which are designed to preclude removal from outside the wall.

In the southwest, stucco type walls are a common treatment to exterior walls of framing, or concrete block. Existing vents for use with such walls generally fail to accommodate the unique properties attendant the construction of stucco wall surfaces and cause the vent and surrounding stucco to be unsightly and generally unacceptable from an aesthetic viewpoint. Additionally, sealing the junction between conventional vents and the stucco is of questionable merit and water readily seeps therebetween as a result of rain or other wetting of the exterior wall.

Many residential garages have gas fired water heaters located therein. These heaters require make-up air to provide a continuing source of oxygen to maintain complete combustion and reduce the emission of deadly carbon monoxide. Many municipalities are redrafting or adopting building codes that require vents in an exterior wall enclosing a gas fired water heater. Generally, such vents must be within 12 inches of the ceiling and of the floor to insure an adequate source of make-up air through convection or otherwise. As mentioned above, many presently available vents for this purpose are either inadequate as security devices to preclude entry into the garage, are unsightly, compromise the integrity of the exterior wall against intrusion, or do not adequately prevent intrusion of moisture due to rain.

SUMMARY OF THE INVENTION

A louvered panel of a vent is supported by top, bottom, left and right panels forming a boxlike structure. Right angled flanges extend from the edges of the top, bottom, left and right sidewalls for attachment by nails or screws to an underlying frame defining the opening covered by the vent. A screen serving as an insect barrier is juxtaposed with the interior surface of the louvered panel and held in place by tabs bent inwardly from one or more of the top, bottom, left and right sidewalls. Upon bending of the tabs, slots are formed that may serve as openings through which the nails or screws are inserted to secure the vent in place. The depth of the top, bottom, left and right sidewalls corresponds with the thickness of conventional stucco wall construction external of the supporting studs (of framing) whereby the louvered panel is flush with the stucco wall. To make the vent moisture resistant, the panels of the vent would be imperforate and the screen would be retained in place by internal flanges. When used with concrete block walls, whether or not a stucco finish is added, slots in the top panel are formed to receive bolts or other fastening means to secure a lintel that extends laterally from the vent to be supported by the adjacent concrete blocks and prevents the concrete blocks above the vent from crushing the vent. The slots permit repositioning of the vent relative to the lintel to accommodate for the additional depth of a stucco finish on the concrete block wall. Moreover, a plate may be attached to the bottom panel to extend laterally across any adjacent cells of underlying concrete blocks; it is also positionally adjustable like the lintel to accommodate placement of the vent to accommodate a stucco finish. When used with a brick wall, the vent is attached to the framing and a right angle lintel extends across the top rear of the vent to be supported by the adjacent bricks and prevents the bricks above the vent from crushing the vent.

It is therefore a primary object of the present invention to provide a moisture resistant combustion air vent for use with an exterior wall of framing having a stucco finish.

Another object of the present invention is to provide a combustion air vent for an exterior wall of concrete block with or without a stucco finish.

Still another object of the present invention is to provide a combustion air vent for an exterior wall of bricks adjacent the framing.

Yet another object of the present invention is to provide a combustion air vent with a positionable plate which will shield adjacent cells in concrete blocks which are only partly covered by the vent.

A further object of the present invention is to provide a combustion air vent secured in place prior to applying a stucco finish to the attendant framing or concrete blocks of an exterior wall.

A still further object of the present invention is to provide a combustion air vent having an attached lintel protruding into a course of concrete blocks or extending along the rear surface of a course of bricks to provide support for the overlying concrete blocks or bricks.

A yet further object of the present invention is to provide a combustion air vent easily installable in a brick wall or a frame or concrete block wall with or without a stucco finish and method for installing same.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
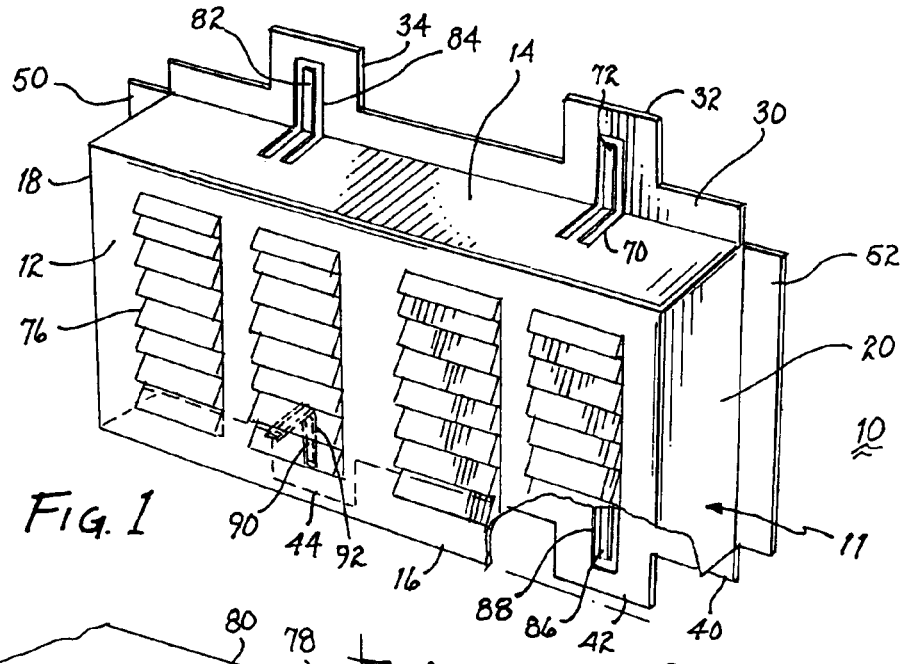
FIG. 1 is a perspective view of a combustion air vent particularly adapted for use with an exterior wall having a stucco finish.

Referring to FIG. 1, there is illustrated a combustion air wall vent 10 formed in the shape of an open ended box 11 providing airflow through a louvered panel 12. The louvered panel is supported by top, bottom, left and right sidewalls or panels 14, 16, 18, 20, respectively. A flange 30 extends from panel 14 at an angle of approximately 90 degrees. This flange may include a pair of extensions 32, 34 particularly adapted, as will be described below, for securing flange 30 to an underlying cross member extending between two wall studs. A similarly configured and oriented flange 40 extends from bottom panel 16; it may also include extensions 42, 44 for attachment to another cross member extending between wall studs. A flange 50 extends at approximately 90 degrees from left side panel 18. This flange may be in juxtaposed relationship with a wall stud and be attached thereto. A flange 52, similar to flange 50, extends from right side panel 20 for bearing against and attachment to an underlying wall stud.

Figure 2:
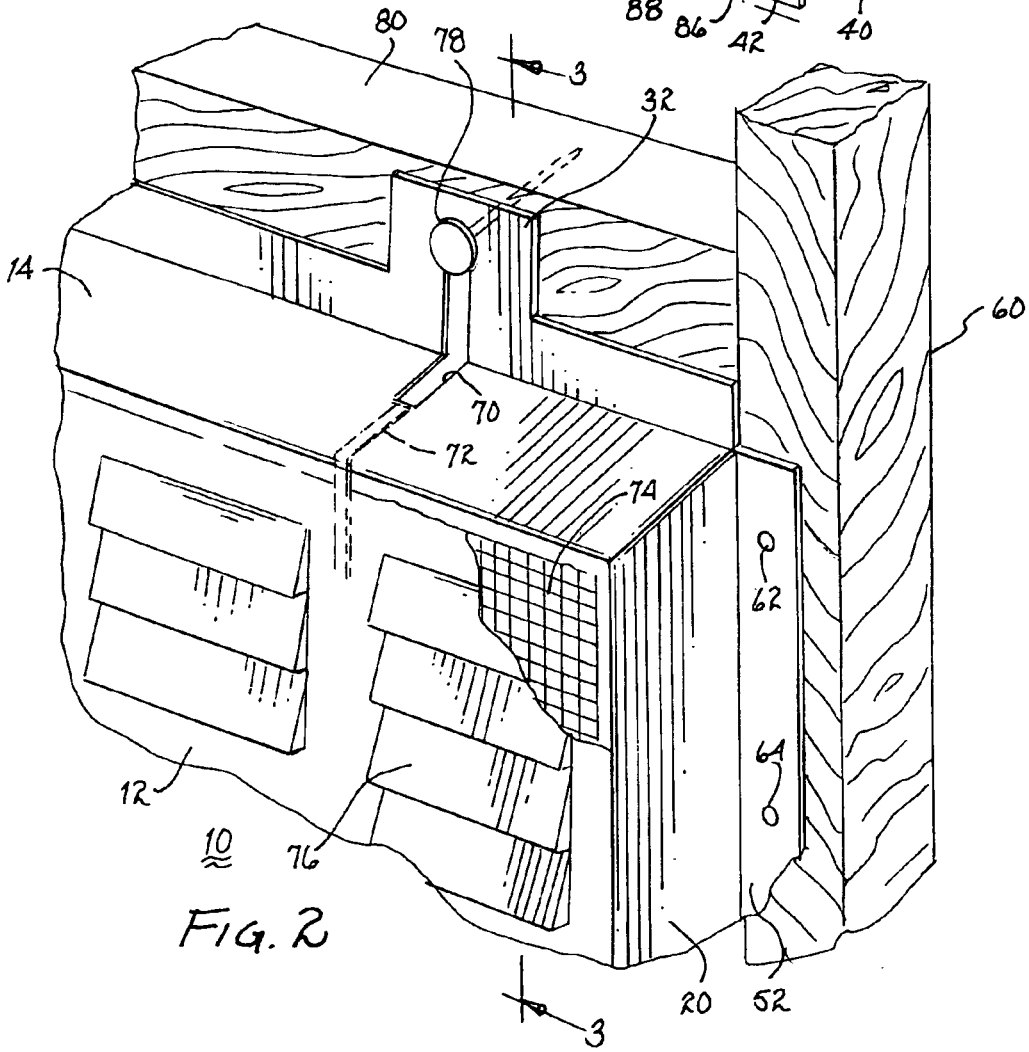
FIG. 2 is a partial view illustrating the attachment of the combustion air vent.
Figure 3:
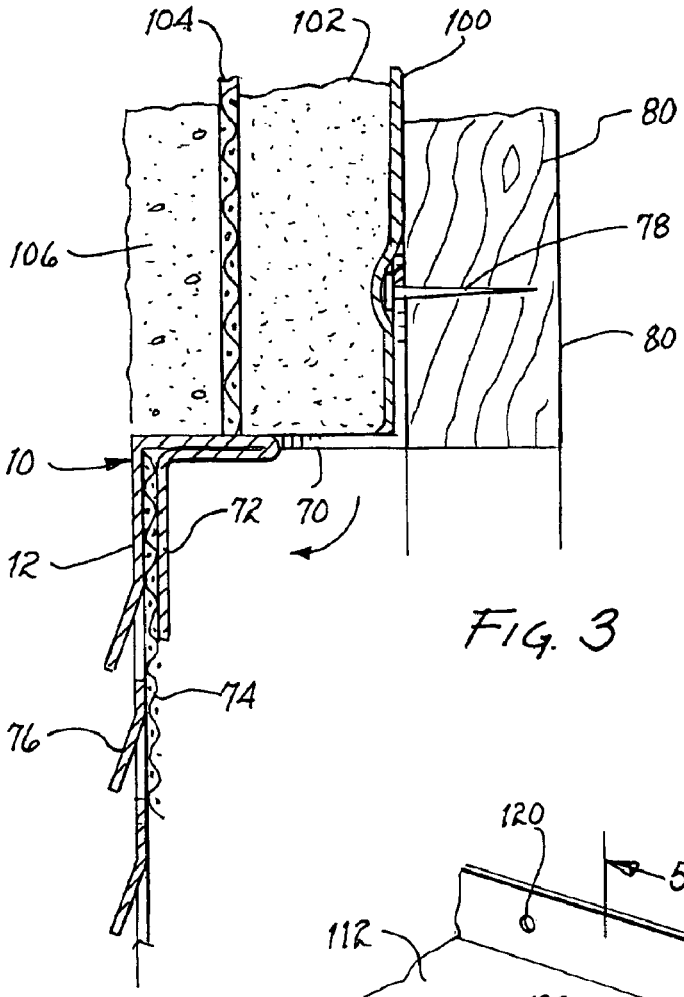
FIG. 3 is a cross-sectional view taken along lines 3—3, as shown in FIG. 2.

Referring jointly to FIGS. 2 and 3, further details of combustion air vent 10 will be described. Flange 52 is supported by adjacent wall stud 60. The flange may be attached to this stud by screws, nails or other fastening means penetrably engaging apertures 62, 64 in flange 52. Flange 50 (see FIG. 1) may be similarly attached to a stud. Extension 32 and part of top panel 14 includes a slot 70 formed to define a right angle tab 72 extending from the top panel 14. An insect screen 74 of mesh or similar material is placed adjacent the inside surface of louvered panel 12 to preclude intrusion of insects through the apertures defined by louvers 76. Bending tab 72 approximately 180 degrees at its junction with top panel 14 will position a segment of the tab adjacent screen 74 and retain the screen adjacent louvered panel 12, as particularly illustrated in FIG. 3. Slot 70 will now be open and a screw or nail 78 or other fastening means may be driven therethrough into cross member 80 to secure extension 32, and vent 10, to the cross member.

Extension 34 (see FIG. 1) includes a similar tab 82 disposed within slot 84; this tab is also bent to hold screen 74 in place as described above with respect to tab 72. Extensions 42 and 44 include similar tabs 86, 90 disposed within slots 88, 92, respectively, and for the same purpose as tab 72. Moreover, slots 84, 88 and 92 serve as apertures through which a screw, nail or other fastening means may be inserted to engage an underlying cross member.

As described above, combustion air vent 10 is secured to the framing of a wall; that is, to the vertical wall studs and cross members therebetween defining an aperture generally corresponding with the size of the vent. To obtain a stucco finish exterior of the wall framing, presently used conventional procedures and construction may be undertaken. As particular shown in FIG. 3, black paper 100, also known as moisture barrier paper, is attached to the framing by conventional means. Industry standard blue board 102 (or white board) is attached adjacent black paper 100 and serves primarily as an insulator. A mesh, such as chicken wire 104, is attached to blue board 102. The chicken wire serves to provide purchase for stucco 106 in the form of a paste troweled onto the chicken wire. Blue board 102 also serves the purpose of providing structural support for the stucco. Upon curing, the stucco forms a relatively hard surface with beneficial insulating properties.

As particularly illustrated in FIG. 3, the depth of combustion air vent 10 conforms with the thickness of the totality of the stucco wall construction. Furthermore, the stucco wall renders inaccessible nail 78, screws or other fastening means used to secure the vent in place. Thus, removal of the vent is impossible without destroying the surrounding parts of the stucco wall. Furthermore, the blue board is easily cut and fitted about the vent by making a series of straight cuts therein. Attachment of the chicken wire about the vent requires no more then a modicum of skill. The stucco paste is readily troweled about the vent and effectively seals the top, bottom, left and right side panels of the vent with the encircling stucco wall.

Figure 4:
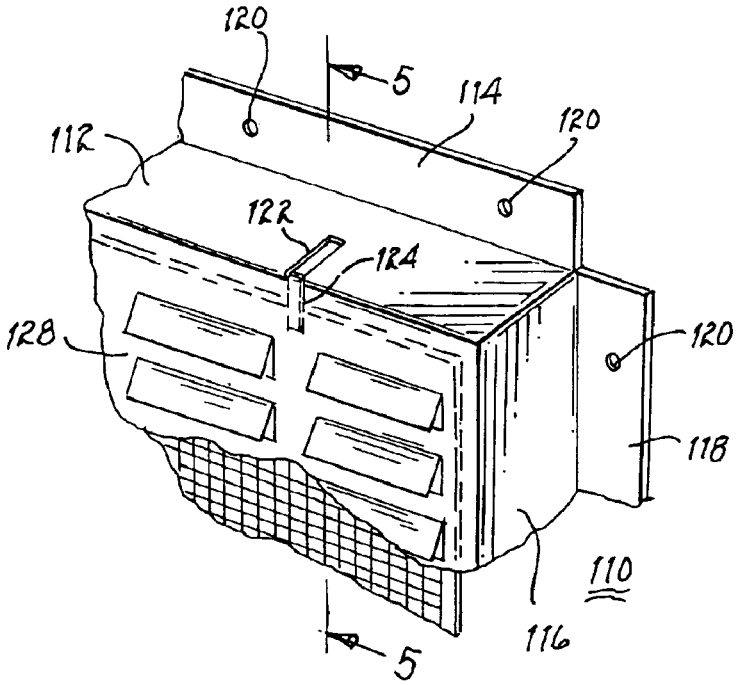
FIG. 4 is a partial perspective view illustrating a variant of the combustion air vent.
Figure 5:
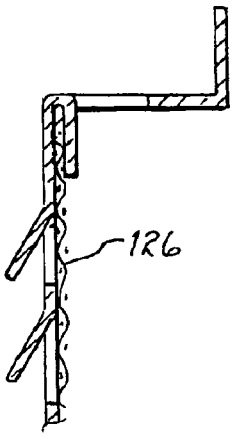
FIG. 5 is a cross-sectional view taken along lines 5—5, as shown in FIG. 4.

Referring jointly to FIGS. 4 and 5, there is shown a variant 110 of combustion air vent 10. Herein, top, bottom, left and right side panels include right angled flanges, of which top panel 112, its flange 114 and right side panel 116 and its flange 118 are shown. Each of the flanges includes one or more apertures 120 for penetrably receiving nails, screws or other fastening means to be used to attach variant 110 to the underlying wall studs and cross members. A slot 122 may be formed in one or more of the top, bottom, left side and right panels to define a bendable tab 124. Each tab is bent approximately 90 degrees to locate the tab adjacent and retain insect screen 126 juxtaposed with louvered panel 128. As will be evident by inspection of FIG. 3, application of stucco 106 may fall through one or more of slots 122. Under normal circumstances, the stucco falling therethrough will be of no consequence. However, to prevent such intrusion of the stucco, a piece of tape or other material may be used to cover the slot after the respective tab is bent.

For purposes of minimizing the cost of vent 10 or variant 110, the vent may be formed from galvanized sheet material. Such sheet material may be of limited benefit in preventing intrusion through the underlying wall by purposefully damaging the louvered panel. To provide a high degree of security, vent 10 or variant 110 may be formed of steel (such as cold rolled steel) of sufficient gauge to prevent destruction of the louvered panel except by extraordinary efforts. It is also contemplated that vent 10 or variant 110 may be formed of a plastic or other manmade material by conventional low cost processes.

In summary, vent 10 or variant 110 may be formed relatively inexpensively by presently well known manufacturing processes from any of various materials. The parts count is very low to enhance the low cost of manufacture, storage and shipping. Installation of the vent or the variant is easily performed by even low skilled artisans and may be rapidly performed which further enhances minimizing costs. Because the workman applying the stucco wall to the framing can easily accommodate the disruption caused by vent 10 or variant 110 to provide a uniform wall with little likelihood of error or mistake, little, if any, additional cost is incurred by forming the stucco wall about the vent or the variant. Finally, the louvered panel is essentially flush with the final wall surface and provides little, if any, aesthetic disruption to the final exterior wall.

Figure 6:
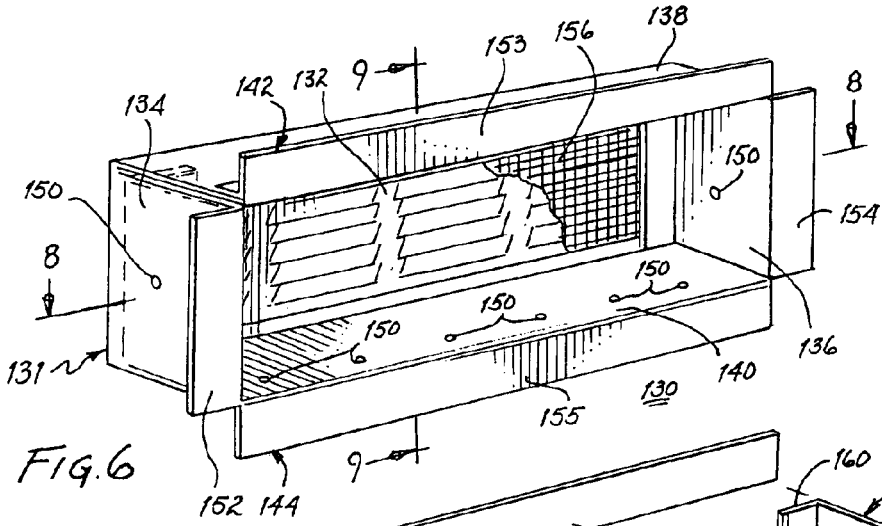
FIG. 6 illustrates a perspective view of a moisture resistant combustion air vent.
Figure 7:
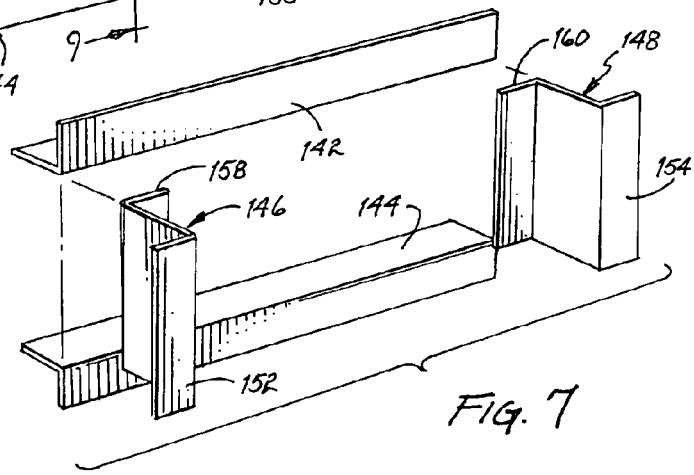
FIG. 7 illustrates angled elements used in the combustion air vent shown in FIG. 6.
Figure 8:
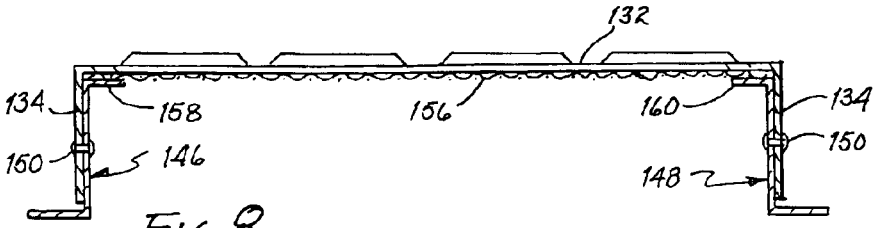
FIG. 8 is a cross-sectional view taken along lines 8—8, as shown in FIG. 6.
Figure 9:
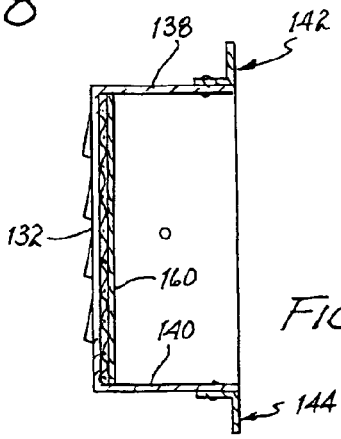
FIG. 9 is a cross-sectional view taken along lines 9—9, as shown in FIG. 6.
Figure 21:
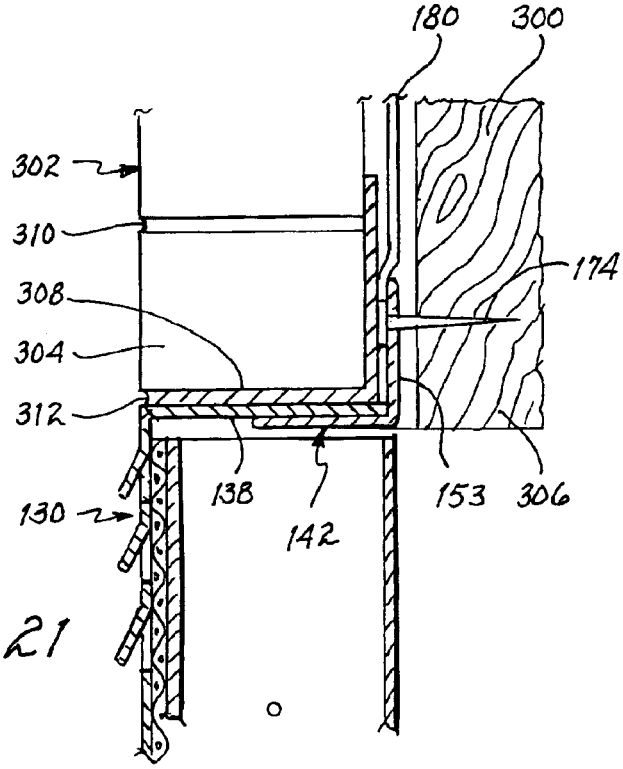
FIG. 21 is a cross-sectional view of a combustion air vent mounted in a brick wall.

Referring to FIG. 6, there is illustrated a moisture resistant vent 130 formed in the shape of an open ended box 131 constructed of heavy gauge sheet metal (or steel) to discourage destruction of the vent for purposes of mischief or intrusion; it is understood that other materials, such as plastic or other man-made materials can also be used to form the vent. The vent includes a louvered front panel 132, which louvers define a plurality of apertures through which air may flow. The louvered panel is supported by side panels 134, 136, top panel 138 and bottom panel 140. The louvered panel and the side panels are bent from a sheet of relatively heavy gauge sheet metal (or made from man-made material) to discourage damage to the vent. As shown in FIGS. 7, 8 and 9, right angle flanges 142, 144 are attached to top panel 138 and bottom panel 140, respectively, by weld 150 or other commonly used fastening/attaching means, such as rivets, sheet metal screws, nuts and bolts, etc. These right angle flanges may be attached to the exterior surfaces as shown or to the interior surfaces (as shown in FIG. 21). These right angle flanges serve in the manner of dams to essentially prevent moisture from seeping along the top panel and/or the bottom panel into the wall in which vent 130 is mounted. Thereby, the right angle flanges tend to provide a moisture barrier. Z-shaped flanges 146, 148 are attached to side panels 134, 136, respectively, by welds 150 or other commonly used fastening/attaching means. These Z-shaped flanges serve two purposes. Panel 152 of Z-shaped flange 146 extends laterally outwardly from side panel 134. Panel 154 of Z-shaped flange 148 extends laterally outwardly from side panel 136. Panels 152, 154 serve in the manner of dams to prevent water seepage along the respective side panels and into the supporting wall; thereby, they provide a moisture resistant feature.

To prevent intrusion of insects, a screen 156 is placed adjacent the inner surface of louvered panel 132. To retain the screen in place, panel 158 of Z-shaped flange 146 bears against the screen to prevent movement away from the louvered panel. Similarly, panel 160 of Z-shaped flange 148 bears against the screen to prevent movement away from the louvered panel.

Figure 10:
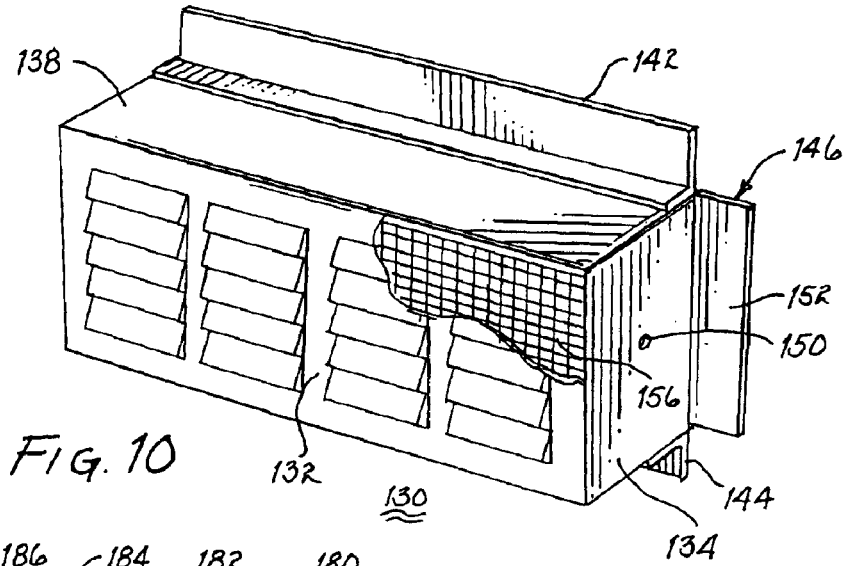
FIG. 10 is a perspective view showing the front of the combustion air vent illustrated in FIG. 6.

FIG. 10 illustrates moisture resistant vent 130 adapted for mounting in the framing of an exterior wall. That is, it is mounted between the vertical wall studs and cross members extending therebetween that define an aperture generally corresponding with the length and height of the vent. As set forth above, the primary structure of vent 130 is constructed of relatively heavy gauge sheet material (or man-made material). As right angle flanges 142, 144 and Z-shaped flanges 146, 148, serve primarily as elements to resist passage of moisture past the panels of the vent, they may be of light gauge sheet metal (or man-made material) for cost purposes without compromising ease of installation or effectiveness of use.

Figure 11:
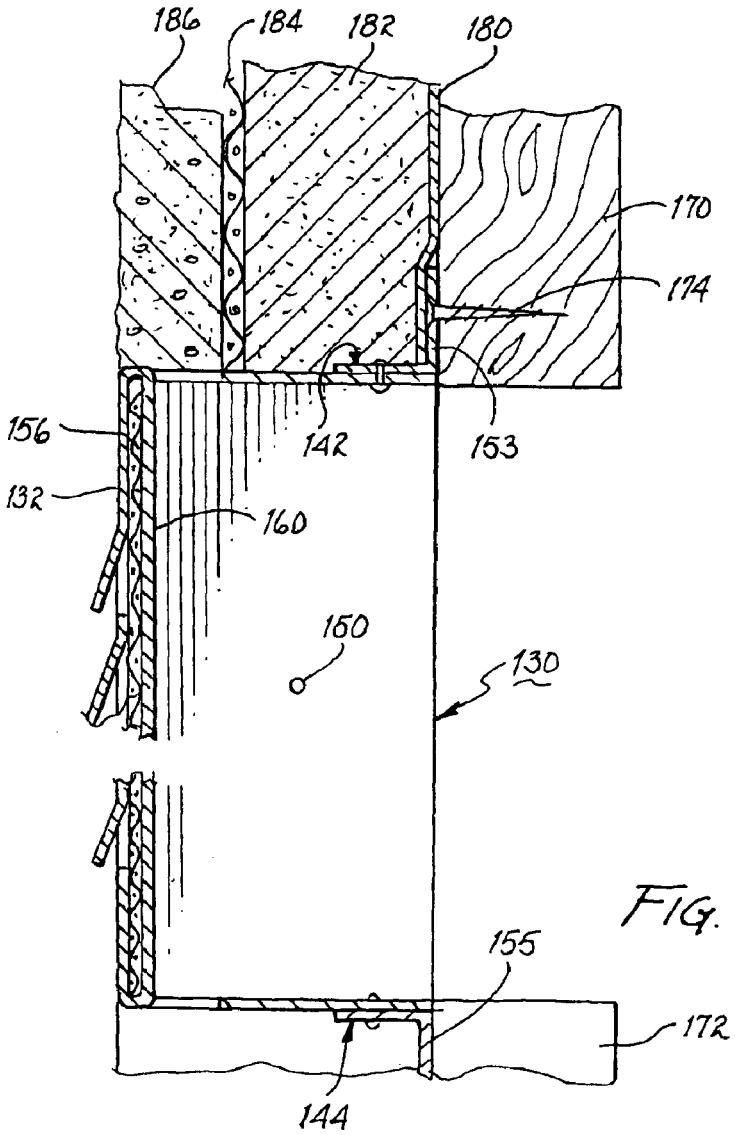
FIG. 11 is a cross-sectional view of the combustion air vent shown in FIG. 10 and illustrating its mounting within a frame construction wall having a stucco finish.
Figure 12:
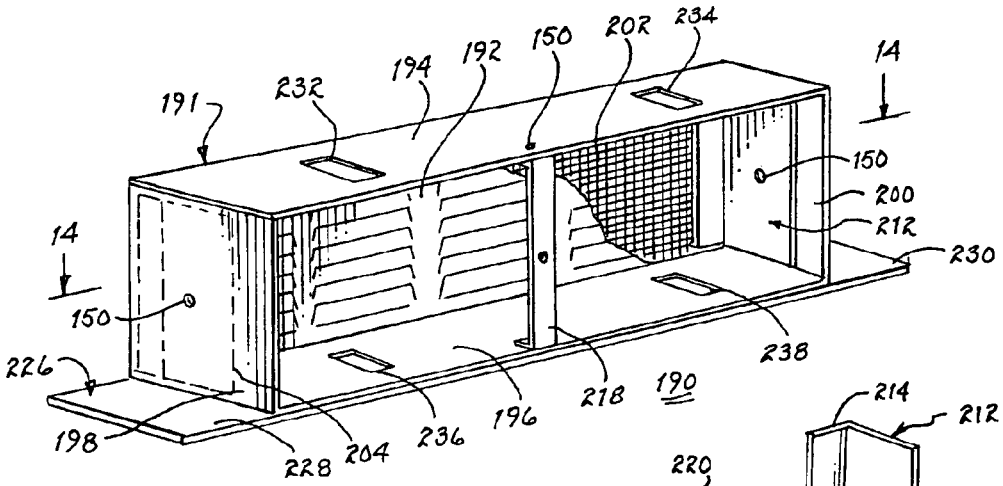
FIG. 12 is a perspective view illustrating a combustion air vent useful in a concrete block wall.
Figure 13:
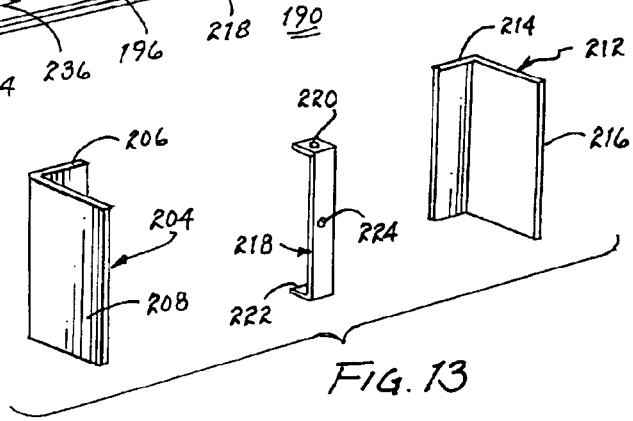
FIG. 13 illustrates angled elements mounted within the combustion air vent shown in FIG. 12.
Figure 14:
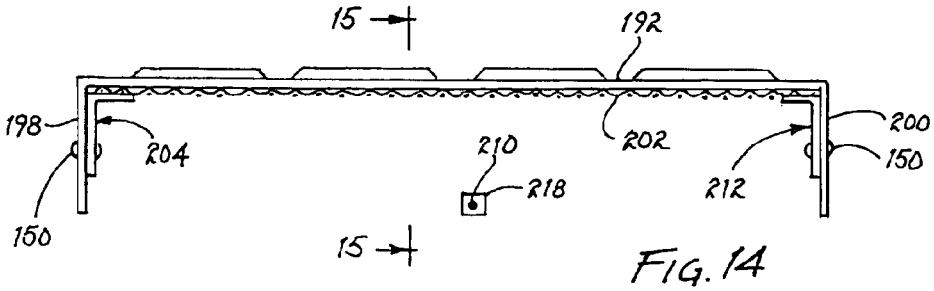
FIG. 14 is a cross-sectional view taken along lines 14—14, as shown in FIG. 12.
Figure 15:
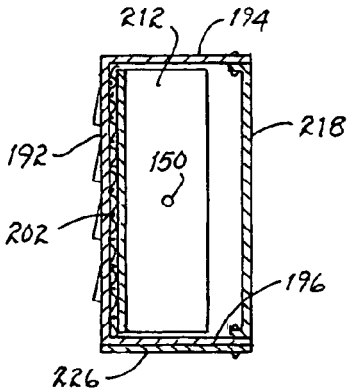
FIG. 15 is a cross-sectional view taken along lines 15—15, as shown in FIG. 14.

Moisture resistant vent 130 is secured to cross members 170, 172, as shown in FIG. 11, by nails or screws 174 extending through each of panels 153, 155 of right angle flanges 142, 144, respectively. Because of the light weight of the these right angle flanges, a workman can form a hole in the panels by simply taping the end of the screw or nail to pierce the panel; thereby, the additional costs of forming holes to receive the screws or nails need not be undertaken, which results in a manufacturing cost savings. Black paper 180, also known as moisture barrier paper, is attached to the framing by conventional means and extends across each of panels 152, 153, 154 and 155 (see FIG. 7). Industry standard blueboard 182 (or whiteboard) is attached adjacent black paper 180 and serves primarily as an insulator. A mesh, such as chicken wire 184, is attached to blueboard 182. The chicken wire serves to provide purchase for stucco 186 in the form of a paste troweled onto the chicken wire. Blueboard 182 also serves the purpose of providing structural support for the stucco. Upon curing, the stucco forms a relatively hard surface with beneficial insulating properties. As noted from FIG. 11, the blueboard, chicken wire and stucco are essentially in contact with the corresponding top, bottom, left and right side panels of vent 130. Thereby, they serve to resist seepage of moisture adjacent the panels. Any seepage which does occur is halted by panels 152, 153, 154 and 155 extending laterally from the corresponding top, bottom and sides of the vent.

Referring jointly to FIGS. 12, 13, 14 and 15, an alternate construction of vent 190 formed in the shape of an open ended box 191 will be described, which vent is particularly adapted for use in a concrete block wall. The vent is bent from a sheet of material, for example as described above, into a box and includes a louvered panel 192 bounded by top panel 194, bottom panel 196, and side panels 198, 200. A screen 202 disposed adjacent the inside surface of louvered panel 192 to prevent entry of insects through the openings defined by the louvers. Right angle flange 204 includes a panel 206 and a panel 208. Panel 208 is attached to panel 198 by a weld 150, rivets, adhesive or other attachment means, or the like, well known in the industry for securing pieces of sheet metal to one another. Upon attaching the right angle flange to the side panel, panel 206 of the flange bears against and retains screen 202 in place. A right angle flange includes a panel 214 and a panel 216. Upon attaching panel 216 to side panel 200 of the vent by a weld 150, or the like, panel 214 will bear against screen 202 and retain it adjacent the inside surface of front panel 192. An optional bar 218 may be disposed at the rear edges of top panel 194 and bottom panel 196. Tabs 220, 222 are secured to the respective top and bottom panels by welds 150, rivets, or other attachment means. The bar includes a hole 224 for reasons set forth below. A plate 226, which may be in a form of an elongated sheet of metal, as illustrated, is adjacent bottom panel 196. The plate may include lateral extensions 228, 230 extending beyond side panels 198, 200. A pair of slots 232, 234 are formed in top panel 194 and extend essentially front to back. A similar pair of slots 236, 238 are formed in bottom panel 196. Holes or slots are formed in plate 226 and correspond with slots 232, 234.

Figure 16:
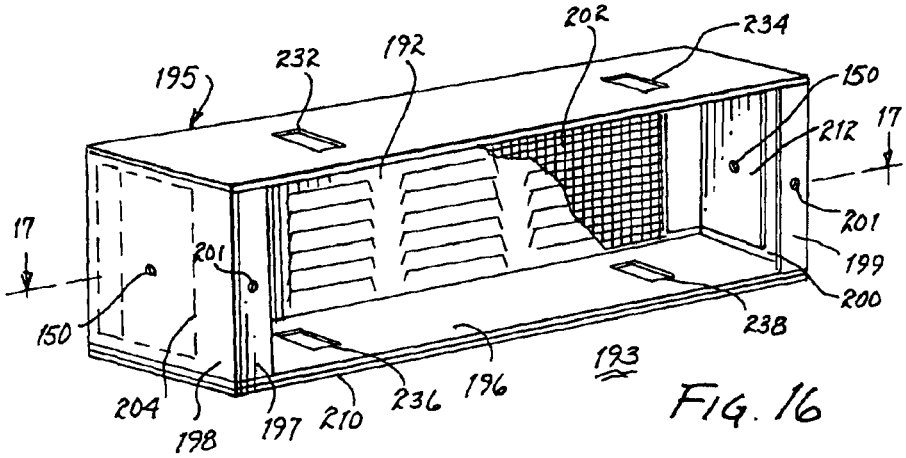
FIG. 16 is a perspective view of a variant of the combustion air vent shown in FIG. 12.
Figure 17:
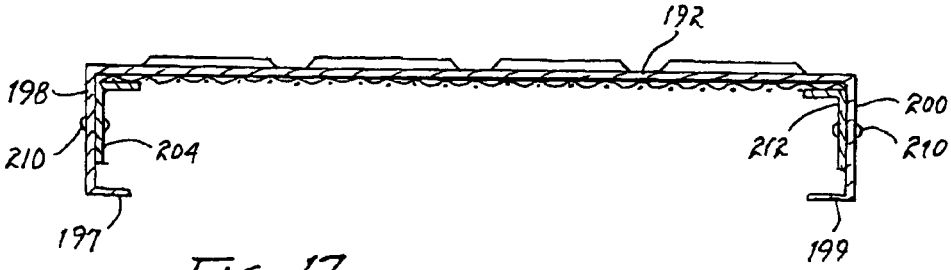
FIG. 17 is a cross-sectional view taken along lines 17—17, as shown in FIG. 16.
Figure 17A:
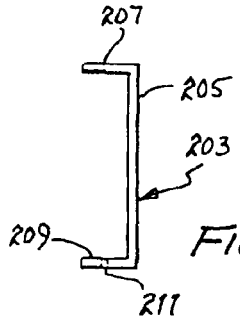
FIG. 17A illustrates a variant of the angled elements attached to the sidewalls of the vent.
Figure 19B:
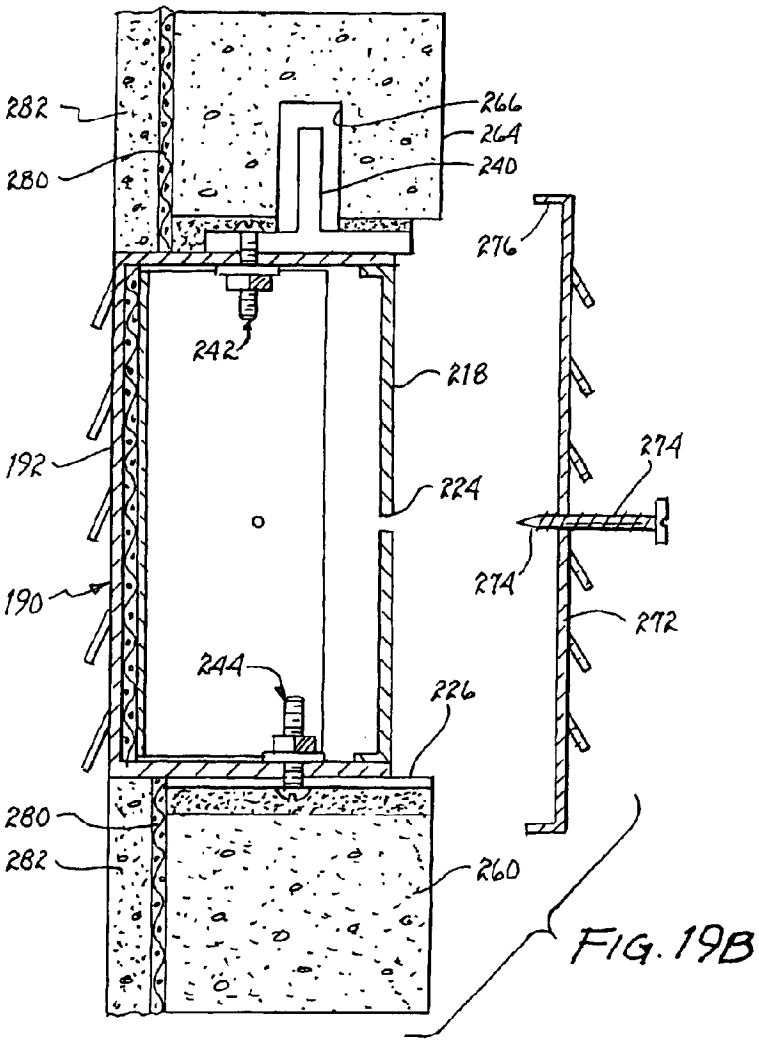
FIG. 19B is a cross-sectional view of the combustion air vent shown in FIG. 18 mounted in a concrete block wall having a stucco finish.
Figure 19A:
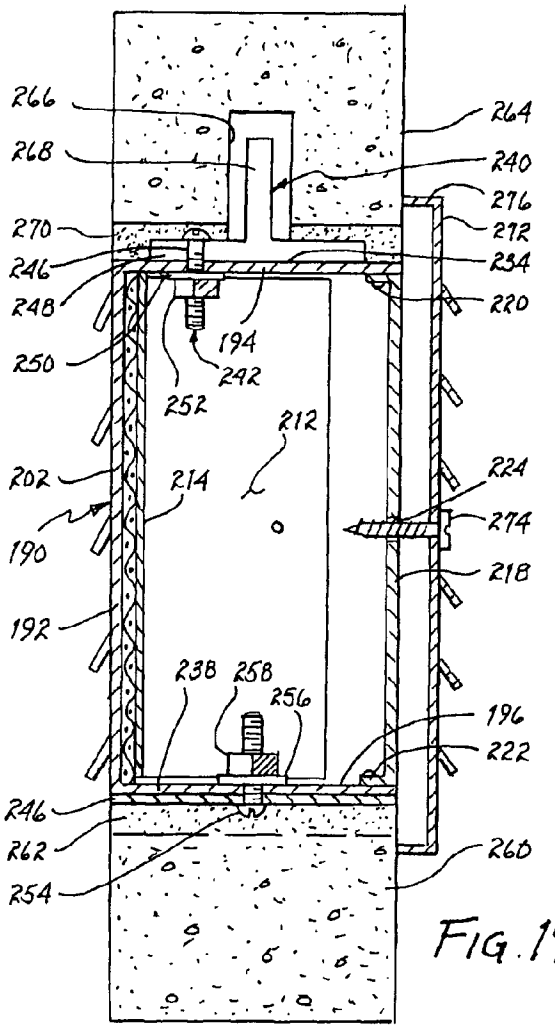
FIG. 19A is a cross-sectional view of the combustion air vent shown in FIG. 18 mounted within a concrete block wall.

FIG. 16 illustrates a variant vent 193 and FIG. 17 illustrates a cross section thereof taken along lines 17—17 as shown in FIG. 16. As variant vent 193 is very similar in many respects with respect to vent 190 illustrated in FIGS. 12, 13, 14 and 15, elements in common will be identified by common reference numerals. The purpose of variant vent 193 is that of providing alternate or additional structure for attaching a rear mounted louvered panel (as shown in FIGS. 19, 19A). Furthermore, the variant vent is particularly adapted for use in a concrete block wall as shown in further detail in FIGS. 19A and 19B. Side panels 198, 200 include inwardly bent panels 197, 199, respectively. Each of these panels may include one or more holes 201 for penetrably receiving screws, rivets, etc. for attaching a louvered panel. As particularly shown in FIG. 17, panels 197, 199 may be bent inwardly at approximately 90 degrees (90°). Alternatively, right angle flange 204 and right angle flange 212 may be extended rearwardly and include a bent panel to serve the purposes of panels 197, 199. FIG. 17A representatively illustrates such a U-shaped flange in cross section, element 203. The element includes a center panel 205 which may be welded or otherwise attached to a respective one of side panels 198, 200. An end panel 207 would bear against screen 202 to retain it in place. A further end panel 209 would be used in the manner of panels 197, 199 to secure a louvered panel to variant vent 193. End panel 209 may include one or more holes 211 to penetrably receive screws or other attachment means from the louvered panel. FIG. 16 also illustrates a plate 210 similar to plate 228 shown in FIG. 12 except that this plate has a platform essentially the same size as the bottom panel of the vent.

Figure 18:
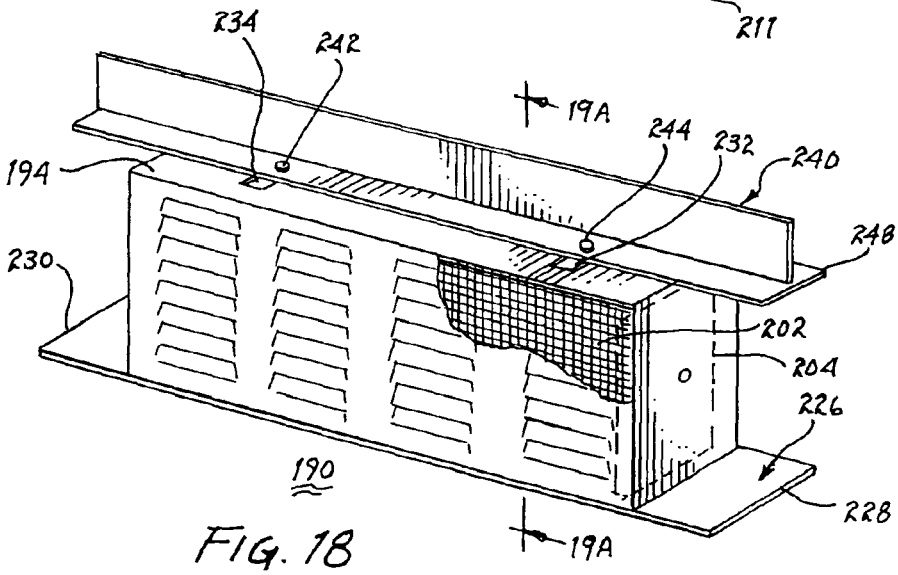
FIG. 18 is a perspective view of a combustion air vent shown in FIG. 12 and having a lintel mounted thereon.

Referring to FIG. 18, there is illustrated the above described vent 190. A lintel 240, T-shaped in cross section, is attached to top panel 194 by attachment means, such as nut and bolt sets 242, 244 penetrably engaging slots 234, 232, respectively. As shown in further detail in FIG. 19A, each of nut and bolt sets 242, 244 securing lintel 240 includes a bolt 246 penetrably engaging section 248 of lintel 240, slot 234, and washer 250 disposed on the underside of top panel 194 and extending across slot 234 into threaded engagement with nut 252. Thereby, lintel 240 is mechanically secured to vent 190. Plate 226 is similarly attached to bottom panel 196 by nut and bolt sets penetrably engaging the support and through slots 236, 238 in the bottom panel. More particularly, each nut and bolt set includes a bolt 254 penetrably engaging plate 226, slot 238, and washer 256 extending across the slot and into threaded engagement with nut 258. Thereby, the plate is rigidly secured to the vent.

Upon installation of vent 190 in a concrete block wall, the vent is placed upon a course of concrete blocks 260, which concrete blocks have cells formed therein, as is conventional. The purpose of plate 226 is that of extending laterally sufficiently from vent 190 to ensure that adjacent partly covered cells (or passageways) in an underlying concrete block are completely covered. Mortar 262 is placed upon the course of concrete blocks 260 as is conventional and plate 226 of vent 190 is placed thereon at a desired/predetermined location. It is to be understood that plate 226 may be omitted in certain installations. The purpose of lintel 240 is to support loads imposed by an overlying course of concrete blocks 264. As noted from FIG. 16, the lintel extends laterally from vent 190 a sufficient distance to obtain and be supported by adjacent concrete blocks. Course of concrete blocks 264 in engagement with lintel 240 are of a commercially available type generally referred to as lintel concrete blocks. That is, they include a slot 266 for the purpose of receiving vertical section 268 of the lintel. As is conventional, mortar 270 is placed on top of vent 190 and lintel 240 to bond course of concrete blocks 264 with the top of the vent and the lintel.

Under certain conditions, it may be desirable to provide a closure to the rear opening provided by vent 190. In such event, a louvered panel 272 may be attached to bar 218 by a sheet metal screw 274, or the like, threadedly engaging hole 224. The louvered panel may include a peripheral lip 276 to bear against the adjacent wall surface, as illustrated. If vent 193 is used (see FIG. 16), louvered panel 272 may be secured to holes 211 in each of panels 197, 199.

The purpose for having slots 232, 234 in top panel 194 and slots 236, 238 in bottom panel 196 is to accommodate positional readjustment of vent 190, as is evident by a comparison between the position of a vent shown in FIGS. 19A and 19B. As shown in FIG. 19B, vent 190 is mounted between courses of concrete blocks 260, 264, as described above. However, in this installation, the exterior wall of concrete blocks will have a stucco finish. In order for louvered panel 192 of vent 190 to be essentially aligned with the exterior surface of the stucco finish, the vent must be repositioned outwardly from the wall a distance commensurate with the depth of the stucco finish. To provide such repositioning while accommodating the fixed position of slot 266 in course of concrete blocks 264, the attachment of lintel 240 to vent 190 is further to the rear than the attachment shown in FIG. 19A. Accordingly, louvered panel 192 will be located outwardly a distance equivalent to the thickness of the stucco finish. Similarly, plate 226 is attached further rearwardly in slots 236, 238 than the attachment shown in FIG. 19A. By the above arrangement, lintel 240 is located in the same position relative to course of concrete blocks 264 as shown in FIG. 19A and plate 226 is located in the same position relative to course of concrete blocks 260 as shown in FIG. 19A. However, vent 190 has been moved outwardly therefrom. The stucco finish may, for example, include chicken wire 280 (lathing) attached to the bricks of the exterior wall and encircling vent 190. The chicken wire serves to provide purchase for stucco 282 which is in the form of a paste troweled onto the chicken wire and structural support for the stucco and chicken wire is provided by the concrete blocks of the exterior wall. As illustrated, the exterior surface of the stucco finish is essentially in the same plane as louvered panel 192 of vent 190.

Figure 20:
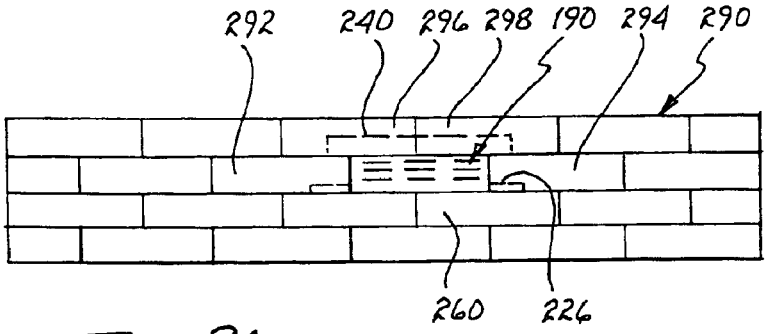
FIG. 20 illustrates a wall of concrete blocks and having the combustion air vent shown in FIG. 18 mounted therein.

FIG. 20 primarily illustrates a concrete block wall 290 having vent 190 mounted therein. It also illustrates plate 226 resting upon course of concrete blocks 260. Lintel 240 is shown as extending laterally to and supported by adjacent concrete blocks 292, 294 disposed at opposed ends of vent 190, which concrete blocks provide support to the lintel and the lintel in turn supports overlying concrete blocks 296, 298. Thereby, vent 190 is not required to provide support for the weight of any overlying concrete blocks. Moreover, plate 226 extends laterally sufficiently to prevent only partial covering by vent 190 of any cells or passageways that may be present in course of concrete blocks 260.

Referring to FIG. 21, there is shown in a representative manner conventional framing 300 for an exterior wall. A wall 302 of bricks 304 is built adjacent framing 300 in the conventional manner. A vent, such as vent 130, shown in FIG. 10, is located adjacent framing 300 in place of one or more bricks in brick wall 302, as representatively shown in FIG. 22. Vent 130 includes a plurality of right angle flanges, such as flanges 142, 144, shown in FIG. 10. A pair of Z-shaped flanges, such as flanges 146, 148 shown in FIG. 10 may be disposed adjacent the side walls of the vent. In the embodiment of vent 130 shown in FIG. 21, right angle flanges, of which right angle flange 142 is shown, are secured to the interior surface of top panel 138, rather to then the exterior surface as shown in FIG. 10. It is to be understood that either mode of attachment of the right angle flanges may be employed. A nail or screw 174 penetrably engages panel 153 of right angle flange 142 for engagement with a cross member 306, or the like, of framing 300; the other right angle flange and Z-shaped flanges may be similarly attached. As is conventional, black paper 180, also known as moisture barrier paper, is attached to the framing by conventional means and extends across panel 153, as well as other panels of the remaining right angle flanges and Z-shaped flanges that may be used with vent 130.

Figure 22:
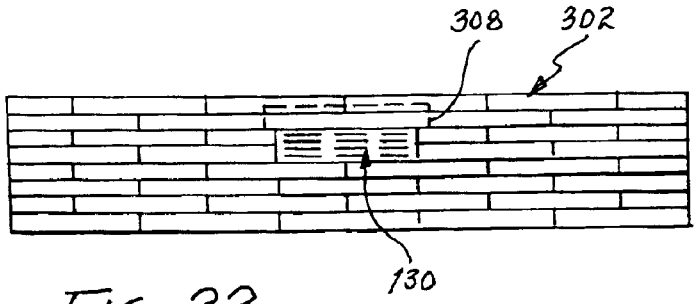
FIG. 22 illustrates a brick wall having a combustion air vent shown in FIG. 21 mounted therein.

A right angle (L-shaped) lintel 308 is abutted adjacent black paper 180 and extends along the top of vent 130 for support from the bricks adjacent opposed ends of the vent, as shown in FIG. 22, to prevent the weight of the bricks overlying the vent from crushing or deforming the vent. Vent 130 need not be in locked engagement with lintel 308 since the vent is secured in place by screws 174 engaging the right angle flanges and Z-shaped flanges. Thus, there is no need for the vent to have the slots shown in FIG. 18 which are used to secure the lintel used with concrete blocks. Not only is the mortar 310 used to secure the bricks to one another but mortar 312 may be placed in the channel formed at the front of the vent between the vent and the adjacent bricks.

Figure 23:
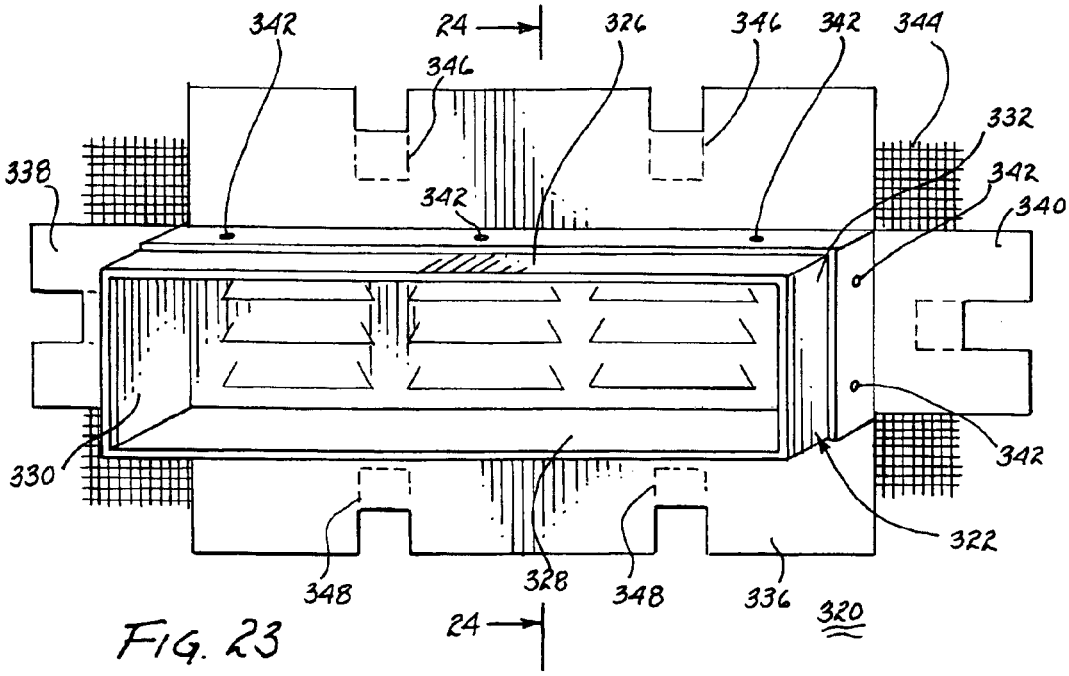
FIG. 23 illustrates a moisture resistant vent having recessed louvers.
Figure 24:
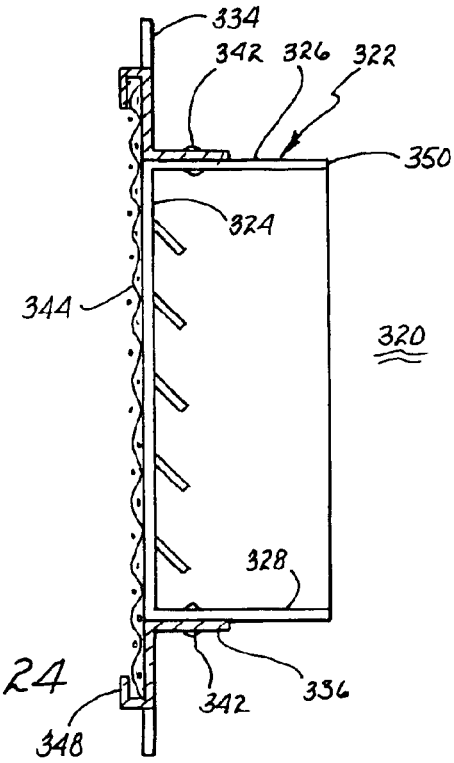
FIG. 24 is a cross sectional view taken along lines 24—24, as shown in FIG. 23.
Figure 27:
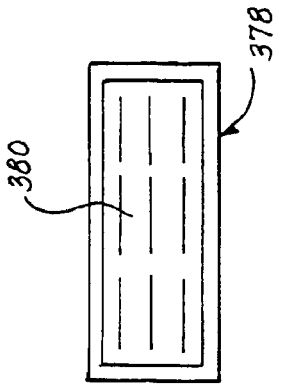
FIG. 27 is a front view of the panel assembly.

Referring to FIGS. 23 and 24, there is illustrated a recessed vent 320. This recessed vent is similar in configuration to vents 10 and 130 and is intended for installation in environments as shown in FIGS. 2, 3 and 11; because such installation will be evident to one skilled in the art, further description thereof need not be undertaken. Recessed vent 320 includes a box 322 formed of louvered panel 324, top panel 326, bottom panel 328, left side panel 330 and right side panel 332. As illustrated, louver panel 324 is at the rear, rather than at the front of box 322. The purpose for such location is that of protecting the louvers of the louvered panel against damage during finishing of the exterior wall in which the recessed vent will be installed. The panels forming box 322 are of relatively heavy gauge sheet metal to prevent damage thereto and to provide the requisite structural strength. It is to be noted, that under certain circumstances and if permitted by pertinent building codes, the box may be formed of plastic or of some other type of man-made material.

To provide a moisture resistant capability to recessed vent 320, a plurality of right angle flanges are secured to each of the panels to extend laterally therefrom. In particular, right angle flange 334 is attached to top panel 326, right angle flange 336 is attached to bottom panel 328, right angle flange 338 is attached to left side panel 330 and right angle flange 340 is attached right side panel 332. Each of these right angle flanges may be attached by conventional attachment means, such as welds 342; however, nut and bolt means, sheet metal screws, rivets, etc., may also be used. An insect screen 344 is placed adjacent the rear surface of louvered panel 324. It is retained in place by tabs 346 formed as part of right angle flange 334 and bent downwardly over the screen, as particularly shown in FIG. 24. Similarly, tabs 348 are formed of right angle flange 336 and bent upwardly over the corresponding edge of insect screen 344 to retain it in place.

The right angle flanges serve as moisture barriers to prevent seepage of water along box 322 into the exterior wall. Furthermore, these right angle flanges are attached by nails, screws, etc., to studs and cross members of the framing forming a part of the exterior wall, as described above. The forward extension of box 322 from louvered panel 324 is commensurate in length with the thickness of the exterior wall surface to be built after installation of recessed vent 320. Thereby, exterior edge 350 of recessed vent 320 will be essentially coincident with the surface of the final finish, such as stucco, of the exterior wall.

Beginning about ten years ago, the construction industry in North America began using insulating concrete forms (hereinafter referred to as ICF). These are modular blocks made of expanded polystyrene and used for concrete walls, floors and ceilings for residential and commercial buildings. These blocks are hollow and the lower edges includes mortises and the top edges include tenons to permit nesting. Once erected, re-bars are passed vertically and horizontally through a central hollow portion and concrete is poured therein. After the concrete is cured, the forms stay in place and provide insulation for both the interior and exterior sides of the wall.

Figure 26:
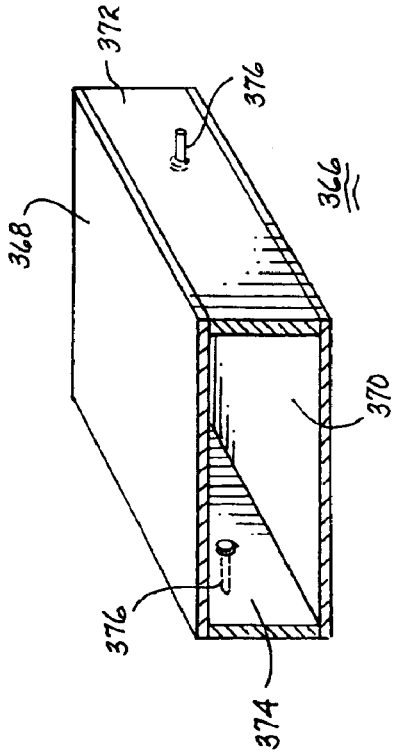
FIG. 26 is a perspective view of a buck.
Figure 25:
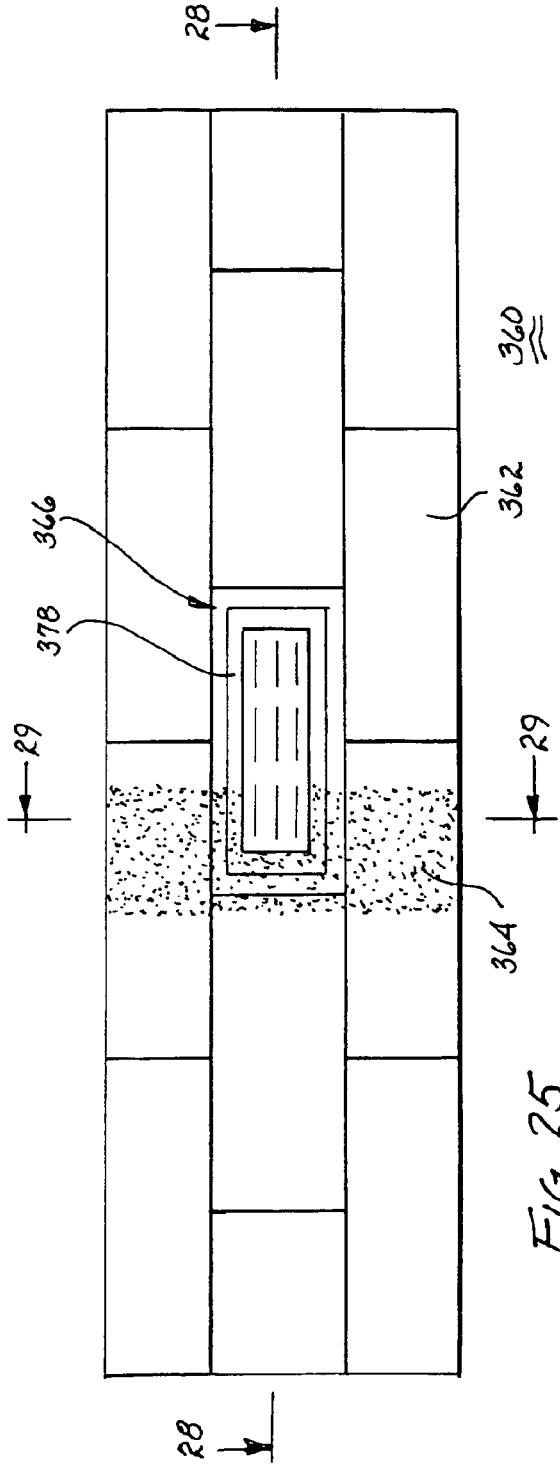
FIG. 25 illustrates a representative wall of insulating concrete forms having a vent assembly disposed therein.

A typical ICF wall 360 is illustrated in FIG. 25. Each of ICF blocks 362 is laid in typical fashion for a block wall, as illustrated. Such a block wall may have a stucco type finish, as identified by numeral 364 in FIG. 25. One of the above described vents may be incorporated in ICF wall 360, as will be described below. A buck 366, which is a term of art defining a passageway typically made of four pieces of wood or plywood, may be dimensioned equivalent to one of ICF blocks 362 and is laid during assembly of ICF wall 360; it may also be of a size smaller than block 362. As shown in further detail in FIG. 26, buck 366 includes top and bottom panels 368, 370 and side panels 372, 374. Nails 376, or the functional equivalent, extend through side panels 372, 374 into engagement with adjacent ICF blocks to retain the buck in place. A vent assembly 378, to be described in further detail below, is attached to buck 366 to provide for air flow through the passageway defined by the buck. Typically, vent assembly 378 includes a louvered panel 380 defining the exterior end of the vent.

Figure 28:
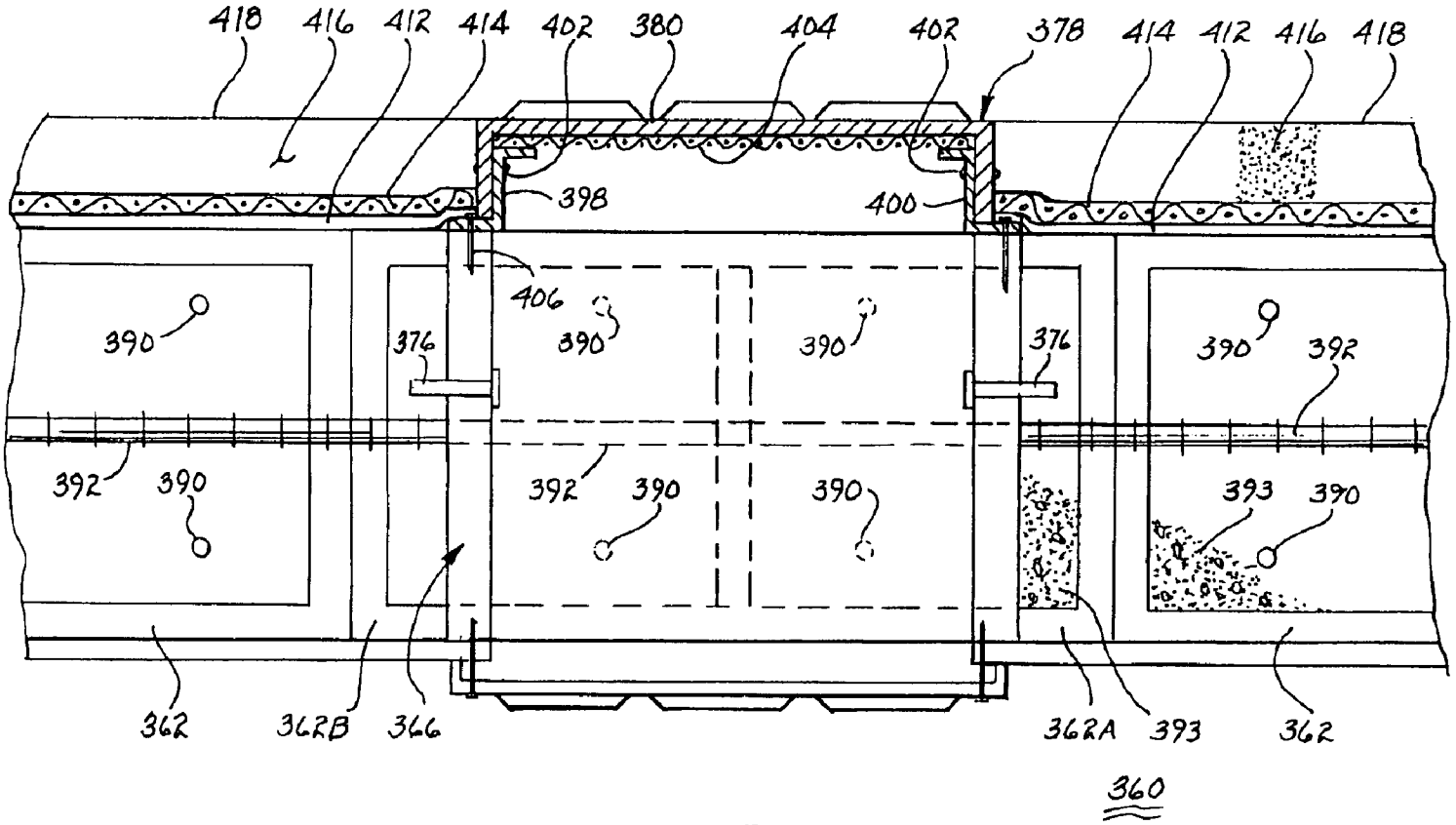
FIG. 28 is a horizontal cross sectional view taken along lines 28—28, as shown in FIG. 25.
Figure 29:
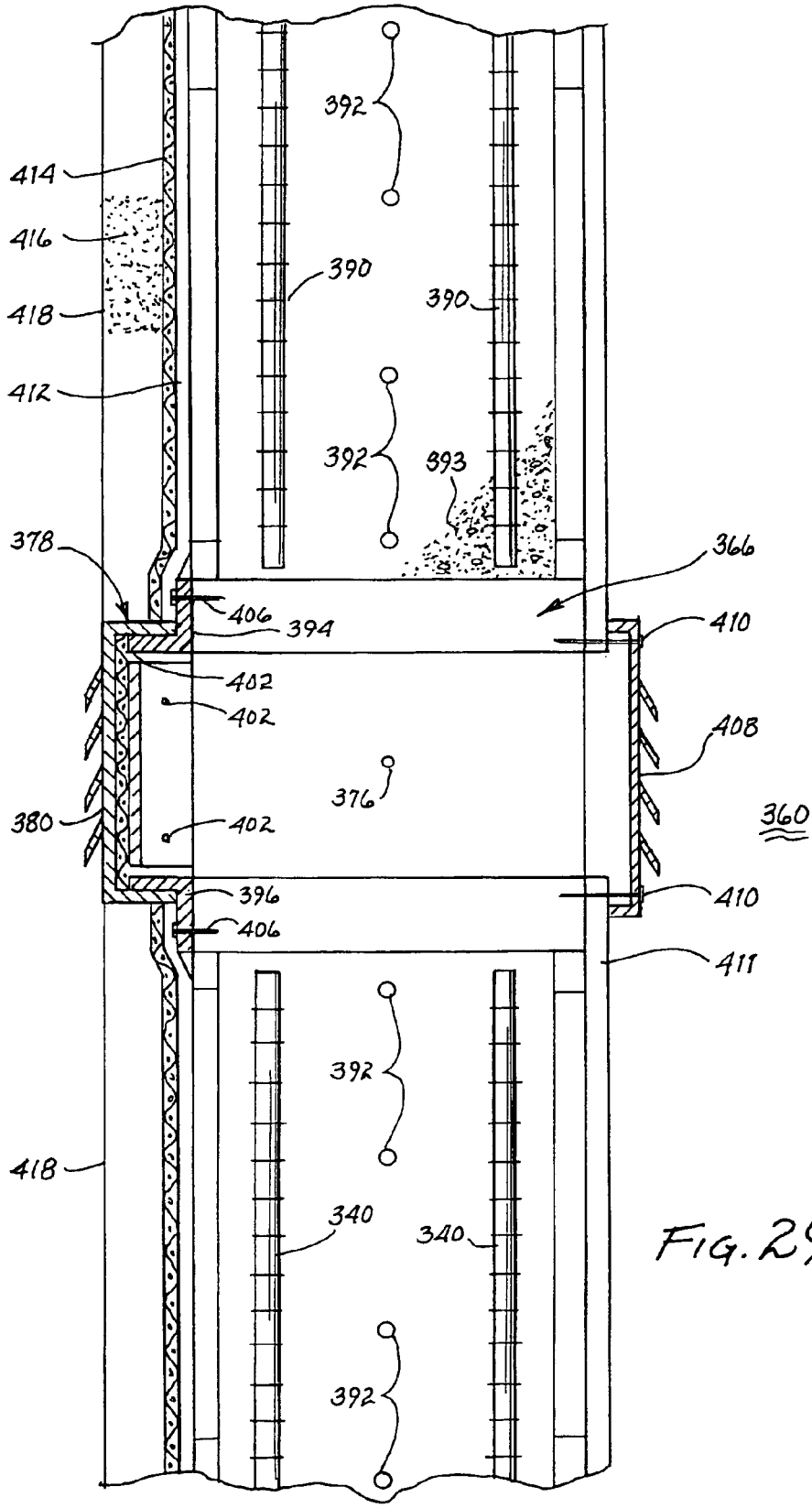
FIG. 29 is a vertical cross sectional view taken along lines 29—29, as shown in FIG. 25.

Referring jointly to FIGS. 28 and 29, there is illustrated a horizontal cross sectional view and a vertical cross sectional view, respectively, of an ICF wall 360 incorporating a buck 366 supporting a vent assembly 378. Herein, buck 366 is shown as having a width less than that of an ICF block 362 in order to illustrate that the ICF blocks may be readily cut to locate a buck between a pair of ICF blocks in a course of ICF blocks. Thus, numeral 362A refers to a section of an ICF block located between buck 366 and ICF block 362 and numeral 362B identifies the section of an ICF block between buck 366 and a further ICF block 362. A plurality of re-bars (reenforcement bars) 390 extend vertically through the cavities formed in ICF blocks 362. Similar re-bars 392 extend horizontally through ICF blocks 362. The cavities within the ICF blocks are filled with concrete 393, which concrete is only shown partially for purposes of clarity. As illustrated, the re-bars aligned with buck 366 terminate at or short of the buck. Similarly, concrete 393 is adjacent the corresponding panel of the buck. Nails 376, or the like, extend outwardly from buck 366 and a protruding end becomes enveloped within concrete 393 and captured thereby on curing of the concrete. Thus, buck 366 is securely retained within ICF wall 360.

Vent assembly 378 is similar to vent 130 shown in FIG. 21. That is, it includes a plurality of right angle flanges extending laterally from each of the top, bottom and side panels of the vent assembly and serve as a moisture barrier. As depicted in FIGS. 28 and 29 as well as in FIG. 21, each of right angle flanges 394, 396, 398 and 400 are secured to the interior of the panels of the vent by welds 402 or rivets, sheet metal screws, nut and bolts, etc. . . . The right angle flanges adjacent the side panels may be Z-shaped like Z-shaped flange 146 illustrated in FIG. 7 in order to retain screen 404 adjacent the inside surface of louvered panel 380. Each of the right angle flanges is attached to buck 366 by nails 406, or the like, to attach vent assembly 380 to the buck and retain it rigidly in place. A rear louvered panel 408 may be attached at the rear end of the passageway defined by buck 366. Such attachment may be by nails 410 or the like extending through wall board 411 or other finishing paneling at the interior surface of ICF wall 360. These nails would preferably extend into the buck to ensure rigid attachment.

As illustrated in FIGS. 28 and 29, louvered panel 380 is located at a distance exteriorly of ICF wall 360. The purpose for doing so is that of accommodating a stucco finish on the exterior of the ICF wall. In particular, such finish would include black paper 412 adjacent the surface of the ICF wall to serve as a moisture barrier. Lathing 414 is placed adjacent the black paper and retained in place by conventional construction techniques. Stucco 416 is troweled on the lathing and extends outwardly as representatively illustrated by line 418 in FIGS. 28 and 29.

I claim:

1. A moisture resistant air vent for use in an exterior wall, said vent comprising in combination:

a) a box including a louvered panel, top, bottom, left and right side panels;

b) an insect screen disposed adjacent the interior of said louvered panel;

c) at least one right angle flange, one of said right angle flanges being attached to at least one of said top and bottom panels and having a panel extending laterally away therefrom; and d) at least one Z-shaped flange, one of said Z-shaped flanges being attached to at least one of said left and right side panels and having a first panel extending laterally away from said attached left or right angle panel and a second panel being juxtaposed with said insect screen to retain said screen adjacent the inside surface of said louvered panel.

2. A moisture resistant air vent as set forth in claim 1 wherein one of said right angle flanges is attached to each of said top and bottom panels.

3. A moisture resistant air vent as set forth in claim 1 wherein one of said Z-shaped flanges is attached to each of said left and right side panels.

4. A moisture resistant air vent as set forth in claim 3 wherein one of said right angle flanges is attached to each of said top and bottom panels.

5. An air vent for use in a concrete block wall, said air vent comprising in combination:

a) a one piece box having a louvered panel, top, bottom, left and right side panels;

b) at least one slot disposed in said top panel;

c) a lintel having a vertical section adapted for attachment to said top panel, said lintel extending laterally past said left and right side panels; and d) attachment means for engaging said lintel with said at least one slot in said top panel to secure said lintel to said top panel at a predetermined location to engage said vertical section with a lintel concrete block.

6. An air vent as set forth in claim 5 wherein each of said at least one slot in said top panel extends away from said louvered panel.

7. An air vent as set forth in claim 6 wherein said at least one slot comprises a pair of slots disposed in said top panel.

8. An air vent as set forth in claim 7 wherein said attachment means comprises a nut and bolt set.

9. An air vent as set forth in claim 5 including an insect screen disposed on the inside of said louvered panel.

10. An air vent as set forth in claim 5 wherein said lintel is T-shaped in cross section.

11. An air vent for use in a concrete block wall, said air vent comprising in combination:

a) a box including a louvered panel, top, bottom, left and right side panels;

b) an insect screen disposed on the inside of said louvered panel;

c) a flange attached to each of said left and right side panels for retaining said insect screen in place;

d) at least one slot disposed in said top panel;

e) a lintel adapted for attachment to said top panel, said lintel extending laterally past said left and right side panels; and f) attachment means for engaging said lintel with said at least one slot in said top panel to secure said lintel to said top panel at a predetermined location.

12. An air vent as set forth in claim 11 including a bar disposed intermediate said top and bottom panels and a further louvered panel attached to said bar.

13. An air vent for use in a concrete block wall, said air vent comprising in combination:

a) a box including a louvered panel, top, bottom, left and right side panels;

b) at least one slot disposed in said top panel;

c) a lintel adapted for attachment to said top panel, said lintel extending laterally past said left and right side panels;

d) attachment means for engaging said lintel with said at least one slot in said top panel to secure said lintel to said top panel at a predetermined location; and e) a plate adapted for attachment to said bottom panel, said plate including extensions extending past said left and right panels, at least one slot disposed in said bottom panel and further attachment means for engaging said plate with said at least one slot in said bottom panel at a predetermined location.

14. A moisture resistant air vent for use in a brick wall adjacent framing of an exterior wall, said vent comprising in combination:

a) a box including a louvered panel, top, bottom, left and right side panels, b) at least one right angle flange, one of said right angle flanges being attached to at least one of said top and bottom panels and extending laterally away therefrom; and c) an L-shaped lintel resting upon said box and extending laterally from said left and right side panels and adapted to rest on and receive support from bricks disposed adjacent said left and right side panels to prevent a course of bricks above said box from crushing said box.

15. A moisture resistant air vent as set forth in claim 14 wherein one of said right angle flanges is attached to each of said top and bottom panels.

16. A moisture resistant air vent as set forth in claim 14 including an insect screen disposed adjacent the interior of said louvered panel.

17. A moisture resistant air vent as set forth in claim 16 including a pair of Z-shaped flanges one of said Z-shaped flanges being attached to each of said left and right side panels.

18. A moisture resistant air vent as set forth in claim 17 wherein each of said pair of Z-shaped flanges includes a panel bearing against said insect screen to retain said insect screen in place.

19. A moisture resistant air vent as set forth in claim 14 wherein each of said right angled flanges is adapted for attachment to the framing to retain said box in place.

20. A moisture resistant air vent for use in an exterior wall, said air vent comprising in combination:

a) a box formed of a single sheet of material and having a louvered panel and top, bottom, left and right side panels bent from said louvered panel, said box being formed as a unitary structure;

b) a flange attached to and extending away from each of said top, bottom, left and right side panels adapted to serve as a barrier against seepage of water along a respective panel; and c) said flanges attached to said top, bottom, left and right side panels being of material lighter in gauge than the gauge of the material of said box.

21. A moisture resistant air vent as set forth in claim 20 including an insect screen located adjacent said louvered panel.

22. A moisture resistant air vent for use in an exterior wall, said air vent comprising in combination:

a) a box including a louvered panel, top, bottom, left and right side panels, said box being formed as a unitary structure;

b) a flange attached to and extending away from each of said top, bottom, left and right side panels adapted to serve as a barrier against seepage of water along a respective panel;

c) an insect screen located adjacent said louvered panel, at least one of said flanges includes a panel bearing against said insect screen to retain said insect screen in place; and d) said flanges attached to said top, bottom, left and right side panels being of material lighter in gauge than the gauge of the material of said box.

23. A moisture resistant air vent as set forth in claim 22 wherein each of said flanges attached to said left and right panels includes a panel bearing against said insect screen.

24. A method for venting an exterior wall of framing while resisting intrusion of moisture, said method comprising the steps of:

a) installing a box having a louvered front panel, top, bottom, left and right side panels between the studs of framing of the wall and between cross members extending between the studs;

b) preventing seepage of moisture along each of the top, bottom, left and right side flanges with a flange extending laterally from the respective panel, said top, bottom, left and right side flanges being adapted for attachment to the framing;

c) restricting intrusion of insects through the louvered panel with an insect screen; and d) retaining the insect screen in place with a panel defined by at least one of the flanges extending from the top, bottom, left and right side flanges.

25. The method as set forth in claim 24 wherein said step of retaining is carried out by the left and right side flanges.

26. The method as set forth in claim 24 including the step of forming the box of material of a first gauge and the step of further forming the top, bottom, left and right side flanges of material of a second gauge wherein the second gauge is thinner than the first gauge.

27. The method as set forth in claim 26 wherein said step of forming includes the step of bending a sheet of material to form the louvered panel and the top, bottom and side panels.

28. A method for venting an exterior concrete block wall with or without a stucco finish, said method comprising the steps of:

a) attaching a lintel having a vertical section to a box formed of one piece of sheet material having a louvered front panel, top, bottom, left and right side panels;

b) said step of attaching including the step of securing the lintel with attachment means engaging the lintel and the top panel;

c) adjusting the location of the box relative to the block wall to place the louvered panel in the plane of the finish of the block wall; and locating the lintel relative to the box to engage the recess in an overlying lintel concrete blocks.

29. A method for venting an exterior concrete block wall with or without a stucco finish, said method comprising the steps of:

a) attaching a lintel having at least one vertical section to a box having a louvered front panel, top, bottom, left and right side panels;

b) said step of attaching including the step of securing the lintel with attachment means engaging the lintel and the top panel;

c) locating the lintel to engage the recess in the overlying lintel concrete blocks;

d) adjusting the location of the lintel relative to the box to place the louvered panel essentially in the plane of the finish of the concrete block wall; and e) further attaching a plate to the bottom panel of the box.

30. The method as set forth in claim 29 including the step of further adjusting the location of the plate relative to the box to place the louvered panel essentially in the plane of the finish of the concrete block wall.

31. The method as set forth in claim 29 wherein said step of attaching includes the step of securing the attachment means with at least one slot disposed in the top panel.

32. The method as set forth in claim 29 wherein said step of further attaching includes the step of further attaching the attachment means with at least one slot disposed in the bottom panel.

33. The method as set forth in claim 32 wherein said step of attaching includes the step of attaching the attachment means with a pair of slots disposed in the top panel.

34. A moisture resistant air vent for use in an insulating concrete form wall, said vent comprising in combination:

a) a buck adapted to be lodged in the insulating concrete form wall;

b) a box including a louvered panel, top, bottom, left and right side panels;

c) an insect screen disposed adjacent the interior of said louvered panel;

d) at least one right angle flange, one of said right angle flanges being attached to at least one of said top and bottom panels and extending laterally away therefrom;

e) at least one Z-shaped flange, one of said Z-shaped flanges being attached to at least one of said left and right side panels and having a first panel extending laterally away from said attached left or right angle panel and a second panel being juxtaposed with said insect screen to retain said screen adjacent the inside surface of said louvered panel; and f) attachment means for attaching at least one of said at least one of right angle and Z-shaped flanges to said buck.

35. A moisture resistant air vent as set forth in claim 34 wherein one of said right angle flanges is attached to each of said top and bottom panels.

36. A moisture resistant air vent as set forth in claim 34 wherein one of said Z-shaped flanges is attached to each of said left and right side panels.

37. A moisture resistant air vent as set forth in claim 36 wherein one of said right angle flanges is attached to each of said top and bottom panels.

38. A moisture resistant vent as set forth in claim 37 wherein each of said right angle flanges and said Z-shaped flanges is attached to the inside surface of the respective one of said top, bottom, left and right side panels.

39. A moisture resistant vent as set forth in claim 38 wherein each of said right angle flanges and said Z-shaped flanges is of a lighter gauge material than the material of said box.

40. A moisture resistant vent as set forth in claim 34 including further attachment means adapted for attaching said buck to the insulating concrete form wall.

41. A moisture resistant air vent for use in an exterior wall, said vent comprising in combination:

a) a box having an opening adapted to be located in the plane of the finish of the exterior wall, said box including a louvered panel recessed from said opening and top, bottom, left and right side panels;

b) an insect screen disposed adjacent said louvered panel;

c) at least one right angle flange, one of said right angle flanges being attached to at least one of said top, bottom, left and right panels and extending laterally away therefrom; and d) tabs formed in at least one of said right angle flanges and adapted to be bent to retain said screen adjacent said louvered panel.

42. A moisture resistant air vent as set forth in claim 41 wherein one of said right angle flanges is attached to each of said top and bottom panels.

43. A moisture resistant air vent as set forth in claim 42 wherein a pair of tabs is formed in each of said right angle flanges attached to said top and bottom panels.

44. A moisture resistant air vent as set forth in claim 41 wherein one of said right angle flanges is attached to each of said left and right side panels.

45. A moisture resistant air vent as set forth in claim 44 wherein one of said right angle flanges is attached to each of said top and bottom panels.

46. A moisture resistant air vent as set forth in claim 41 wherein said opening is defined by a front edge of said top, bottom, left and right side panels and wherein each of said right angle flanges is displaced rearwardly from said front edges.

47. A moisture resistant air vent as set forth in claim 46 wherein said top, bottom, left and right panels includes a rear edge and wherein each of said right angle flanges extends laterally from said rear edges.

48. A moisture resistant air vent as set forth in claim 47 wherein said louvered panel is coincident with said rear edges.

49. A moisture resistant air vent as set forth in claim 47 wherein each of said right angle flanges is attached to one of said top, bottom, left and right side panels.

50. A moisture resistant air vent as set forth in claim 49 wherein said tabs are formed in said right angle flanges attached to said top and bottom panels.

51. A method for venting an insulating concrete form wall, said method comprising the steps of:

a) locating a buck in the insulating concrete form wall;

b) attaching a box formed of a single sheet of material and having a louvered panel, and top, bottom, left and right side panels bent from the louvered panel to the buck; and c) said step of attaching including attaching at least some of segregated right angle flanges attached to any of the top, bottom, left and right panels and extending from the box to the buck.

52. The method as set forth in claim 51 wherein said step of attaching including the step of attaching the right angle flanges to the front edge of the buck.

53. The method as set forth in claim 52 wherein the right angle flanges extend from at least the top and bottom panels of the box and wherein said step of attaching includes the step of attaching these right angle flanges to the front edge of the buck.

54. The method as set forth in claim 53 wherein the right angle flanges also extend from the left and right side panels and wherein said step of attaching includes the step of attaching these right angle flanges to the front edge of the buck.

* * * * *